US009235186B2

(12) United States Patent
Hatazaki

(10) Patent No.: US 9,235,186 B2
(45) Date of Patent: Jan. 12, 2016

(54) ELECTROPHOTOGRAPHIC IMAGE FORMING APPARATUS

(71) Applicant: CANON KABUSHIKI KAISHA, Tokyo (JP)

(72) Inventor: Kazunari Hatazaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/603,455

(22) Filed: Jan. 23, 2015

(65) Prior Publication Data

US 2015/0220045 A1 Aug. 6, 2015

(30) Foreign Application Priority Data

Feb. 6, 2014 (JP) ..... 2014-021383

(51) Int. Cl.
*G03G 15/20* (2006.01)
*G03G 21/00* (2006.01)
*G03G 15/16* (2006.01)

(52) U.S. Cl.
CPC ..... *G03G 21/0041* (2013.01); *G03G 15/2025* (2013.01); *G03G 15/161* (2013.01); *G03G 15/2064* (2013.01); *G03G 15/2075* (2013.01); *G03G 2215/0129* (2013.01); *G03G 2215/1695* (2013.01)

(58) Field of Classification Search
CPC ..... G03G 15/20
USPC ..... 399/327, 329
See application file for complete search history.

(56) References Cited

U.S. PATENT DOCUMENTS

| | | | | | |
|---|---|---|---|---|---|
| 5,168,314 | A * | 12/1992 | Gunji et al. | 399/327 |
| 5,768,672 | A * | 6/1998 | van Herpen et al. | 399/327 |
| 5,850,588 | A * | 12/1998 | Yoshikawa | 399/327 |
| 5,930,857 | A * | 8/1999 | Ramos et al. | 15/3 |
| 5,970,298 | A * | 10/1999 | Seki et al. | 399/327 |
| 6,186,066 | B1 * | 2/2001 | Kim | 101/423 |
| 6,490,424 | B2 * | 12/2002 | Okamoto | 399/101 |
| 2003/0156853 | A1 * | 8/2003 | Fukutani | 399/68 |
| 2005/0180786 | A1 * | 8/2005 | Yamada et al. | 399/327 |

(Continued)

FOREIGN PATENT DOCUMENTS

| | | | | |
|---|---|---|---|---|
| JP | 06-194986 A | | 7/1994 | |
| JP | H06194986 | * | 7/1994 | G03G 15/20 |

(Continued)

OTHER PUBLICATIONS

U.S. Appl. No. 14/615,875, filed Feb. 6, 2015.

*Primary Examiner* — Clatyon E LaBalle
*Assistant Examiner* — Kevin Butler
(74) *Attorney, Agent, or Firm* — Fitzpatrick, Cella, Harper & Scinto

(57) ABSTRACT

An electrophotographic image forming apparatus includes: a rotatable member; a web; a mechanism; a contact portion; a plurality of displacing portions; a detecting portion; a notifying portion; a first counting portion; a prohibiting portion; and a second counting portion. The prohibiting portion prohibits an image forming process when the detecting portion detects displacement of the contact portion when the number of times of the image forming process counted by the second counting portion is less than a predetermined number. The notifying portion prompts an exchange of the web when the detecting portion detects the displacement of the contact portion when the number of times is not less than the predetermined number.

13 Claims, 7 Drawing Sheets

(56) References Cited

U.S. PATENT DOCUMENTS

| | | | | |
|---|---|---|---|---|
| 2007/0140757 | A1* | 6/2007 | Poxon et al. | 399/327 |
| 2007/0280753 | A1* | 12/2007 | Tateishi et al. | 399/327 |
| 2009/0123200 | A1* | 5/2009 | Achten et al. | 399/327 |
| 2009/0297186 | A1* | 12/2009 | Fromm | 399/45 |
| 2009/0297233 | A1* | 12/2009 | Kameda | 399/322 |
| 2010/0092219 | A1* | 4/2010 | Fromm et al. | 399/327 |
| 2014/0270866 | A1* | 9/2014 | Hatazaki | 399/327 |

FOREIGN PATENT DOCUMENTS

| | | | | |
|---|---|---|---|---|
| JP | 2004-212409 | * | 7/2004 | G03G 15/20 |
| JP | 2004-212409 | A | 7/2004 | |

* cited by examiner (a) OFF (b) ON

ELECTROPHOTOGRAPHIC IMAGE FORMING APPARATUS

FIELD OF THE INVENTION AND RELATED ART

The present invention relates to an electrophotographic image forming apparatus.

In a conventional electrophotographic image forming apparatus, a fixing process is performed by heating and pressing a toner image, formed on a sheet, by a fixing device.

In image forming apparatuses described in Japanese Laid-Open Patent Application (JP-A) Hei 6-194986 and JP-A 2004-212409, cleaning is made using a cleaning web. This cleaning device has a constitution in which a rotatable member is rubbed with a part of an elongated cleaning web with respect to a movement direction of the cleaning web to remove a toner deposited on the rotatable member.

Then, the toner removed from the rotatable member is held in a fiber texture of the cleaning web, and therefore the elongated cleaning web is used while shifting a rubbing position with the rotatable member little by little by being moved in a longitudinal direction. Accordingly, when the cleaning web is started to be used from the neighborhood of a starting end to reach the neighborhood of the terminal, a normal cleaning performance cannot be continued further.

Therefore, a constitution for urging an exchange of the cleaning web has been proposed. Specifically, a constitution in which a cut-away portion is provided in the neighborhood of the terminal of the cleaning web and a detection flag controlling the surface of the cleaning web is displaced at a position where the cut-away portion is formed, and then displacement of the detection flag is detected by an optical sensor is employed.

In this way, a constitution in which when the optical sensor detects the displacement of the detection flag, the exchange of the cleaning web is urged, and thereafter when the number of sheets subjected to image formation reaches a certain number of sheets, further image formation is prohibited is employed.

Further, in consideration of erroneous feeding of the cleaning web, it was proposed that one cut-away portion was further provided. Accordingly, even in the case where the number of sheets subjected to the image formation after the detection of the first cut-away portion does not reach the certain number of sheets, when the second cut-away portion is detected, further image formation is prohibited.

However, in the case where the two cut-away portions are provided as described above, there is a liability that the following problem arises. That is, in the case where a status such that after the first cut-away portion is detected the detection flag is placed again on the surface of the cleaning web by feeding (moving) the cleaning web without exchanging the cleaning web generates, there is a liability that the problem occurs. In this case, discrimination as to whether the cut-away portion to be subsequently detected is the first cut-away portion or the second cut-away portion cannot be made, so that proper discrimination as to whether the image formation is allowed or prohibited cannot be made.

SUMMARY OF THE INVENTION

According to an aspect of the present invention, there is provided an electrophotographic image forming apparatus comprising: a rotatable member; a web configured to remove a toner, deposited on the rotatable member, in a cleaning position; a mechanism configured to feed an unused portion of the web to the cleaning position every predetermined number of times of an image forming process; a contact portion configured to contact a surface of the web; a plurality of displacing portions formed in different positions with respect to a movement direction of the web and configured to permit displacement of the contact portion; a detecting portion configured to detect the displacement of the contact portion at each of the displacing portions; a notifying portion configured to notify an exchange of the web depending on an output of the detecting portion; a first counting portion configured to count the number of times of the image forming process executed after the contact portion is displaced at each of the displacing portions; a prohibiting portion configured to prohibit the image forming process when the number of times of the image forming process counted by the first counting portion reaches a number of prohibition; and a second counting portion configured to count the number of times of the image forming process executed after the contact portion returns to a contact state with the surface of the web, wherein the prohibiting portion prohibits the image forming process when the detecting portion detects the displacement of the contact portion when the number of times of the image forming process counted by the second counting portion is less than the predetermined number, and wherein the notifying portion prompts the exchange of the web when the detecting portion detects the displacement of the contact portion when the number of times is not less than the predetermined number.

According to another aspect of the present invention, there is provided an electrophotographic image forming apparatus comprising: an image forming portion configured to form a toner image on a sheet; a fixing portion configured to fix the toner image formed on the sheet by the image forming portion; a rotatable member provided in the fixing portion; a web configured to remove a toner, deposited on the rotatable member, in a cleaning position; a mechanism configured to feed an unused portion of the web to the cleaning position every predetermined number of times of an image forming process; a contact portion configured to contact a surface of the web; a plurality of displacing portions formed in different positions with respect to a movement direction of the web and configured to permit displacement of the contact portion; a detecting portion configured to detect the displacement of the contact portion at each of the displacing portions; a notifying portion configured to notify an exchange of the web depending on an output of the detecting portion; a first counting portion configured to count the number of times the image forming process is executed after the contact portion is displaced at each of the displacing portions; a prohibiting portion configured to prohibit the image forming process when the number of times the image forming process is counted by the first counting portion reaches a number of prohibition; and a second counting portion configured to count the number of times the image forming process is executed after the contact portion returns to a contact state with the surface of the web, wherein the prohibiting portion prohibits the image forming process when the detecting portion detects the displacement of the contact portion when the number of times the image forming process is counted by the second counting portion is less than the predetermined number, and wherein the notifying portion prompts the exchange of the web when the detecting portion detects the displacement of the contact portion when the number of times is not less than the predetermined number.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described specifically with reference to the drawings.

Embodiment 1

Image Forming Apparatus

Figure 1:
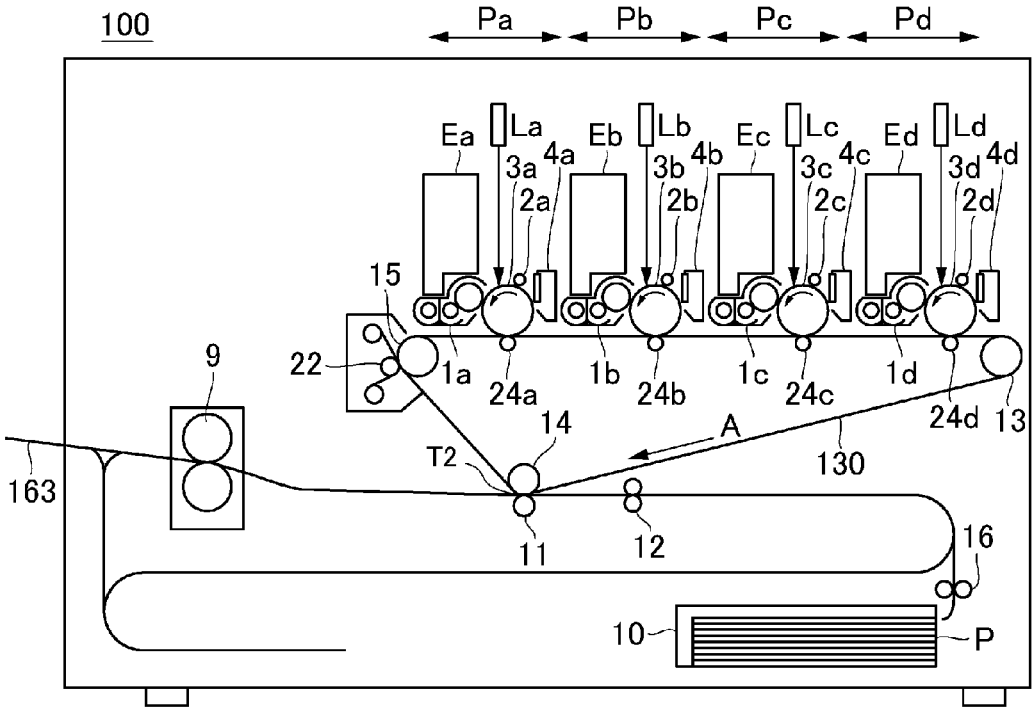
FIG. 1 is an illustration of a structure of an image forming apparatus.

FIG. 1 is an illustration of structure of an electrophotographic image forming apparatus. As shown in FIG. 1, an image forming apparatus 100 in this embodiment is a tandem-type full-color printer of an intermediary transfer type in which image forming portions Pa, Pb, Pc and Pd for yellow, magenta, cyan and black, respectively, are arranged along an intermediary transfer belt 130.

In the image forming portion Pa, a yellow toner image is formed on a photosensitive drum 3*a* and then is transferred onto the intermediary transfer belt 130. In the image forming portion Pb, a magenta toner image is formed on a photosensitive drum 3*b* and is transferred onto the intermediary transfer belt 130. In the image forming portions Pc and Pd, a cyan toner image and a black toner image are formed on photosensitive drums 3*c* and 3*d*, respectively, and are transferred onto the intermediary transfer belt 130.

The four color toner images transferred on the intermediary transfer belt 130 are fed to a secondary transfer portion T2, and then are secondary-transferred onto a sheet P.

A separation roller 16 separates the sheet P, pulled out from a sheet cassette 10, one by on; and is sent to registration rollers 12. The registration rollers 12 send the sheet P to the secondary transfer portion T2 while being timed to the toner images on the intermediary transfer belt 130. The sheet P on which the four color toner images are secondary-transferred is heated by a fixing apparatus 9 to fix the toner images thereon, and thereafter is discharged onto a discharge tray 163. The toner images are formed on the sheet P while leaving a certain margin at each of its four edge portions.

In the case of double-side printing, the sheet P on which the toner images are fixed on a first surface by the fixing device 9 is induced into a reversing path and is switched back to be turned upside down so as to replace a leading end and a trailing end with each other, and then is fed again to the registration rollers 12. Then, at the secondary transfer portion T2, the toner images are transferred onto also the second surface of the sheet P, and then are fixed by the fixing device 9, and thereafter the sheet P is discharged onto the discharge tray 163.

(Image Forming Portion)

The image forming portions Pa, Pb, Pc and Pd have the substantially same constitution except that the colors of toners of yellow, magenta, cyan and black used in developing devices 1*a*, 1*b*, 1*c* and 1*d* are different from each other. In the following description, the image forming portion Pa will be described and other image forming portions Pb, Pc and Pd will be omitted from redundant description.

The image forming portion Pa includes the photosensitive drum 3*a* around which a charging device 2*a*, an exposure device La, the developing device 1*a*, a transfer roller 24*a*, and a drum cleaning device 4*a* are provided. The photosensitive drum 3*a* is prepared by forming a photosensitive layer on an outer peripheral surface of an aluminum cylinder and rotates in an arrow direction at a predetermined process speed.

The charging device 2*a* electrically charges the surface of the photosensitive drum 3*a* to a uniform negative potential. The exposure device La writes (forms) an electrostatic image on the photosensitive drum 3*a* by scanning through a rotating mirror with a laser beam obtained by subjecting a scanning line image signal, developed from an associated color image, to ON-OFF modulation. The developing device 1*a* develops the electrostatic image into the toner image by transferring the toner onto the photosensitive drum 3*a*. A toner cartridge Ea supplies the toner, in an amount correspondingly to an amount consumed by the image formation, to the developing device 1*a*.

The transfer roller 24 urges the intermediary transfer belt 130 to form a transfer portion between the photosensitive drum 3*a* and the intermediary transfer belt 130. By applying a positive DC voltage to the transfer roller 24, the negative toner image carried on the photosensitive drum 3*a* is transferred onto the intermediary transfer belt 130.

The intermediary transfer belt 130 is stretched and supported by a tension roller 15, an inner secondary transfer roller 14 and a driving roller 13, and is driven and rotated in an arrow A direction by the driving roller 13. An outer secondary transfer roller 11 contacts the intermediary transfer belt 130 supported by the inner secondary transfer roller 14 to form the secondary transfer portion T2. By applying a positive DC voltage to the outer secondary transfer roller 11, the toner image is transferred from the intermediary transfer belt 130 onto the sheet P passing through the secondary transfer portion T2.

The drum cleaning device 4*a* rubs the photosensitive drum 3*a* with a cleaning blade to collect a transfer residual toner deposited on the photosensitive drum 3*a*. A belt cleaning device 22 rubs the intermediary transfer belt 130 with a cleaning web 61 to collect a transfer residual toner deposited on the intermediary transfer belt 130.

The developing device 1*a* uses the toner containing (incorporating) paraffin, a wax consisting of polyolefin or a silicone oil as a parting agent. Specifically, a toner obtained by finely dividing a wax component and a pigment into a pulverized toner is used. The developing device 1*a* may also use a polymerization toner containing such a wax component. In the following description, as the parting agent, the wax is described as an example, but also the case where the silicone oil is used as the parting agent is similarly applied. The fixing device 9 heats and presses the toner image formed on the sheet P with the toner, whereby the toner image is fixed on the sheet P.

(Fixing Device)

Figure 2:
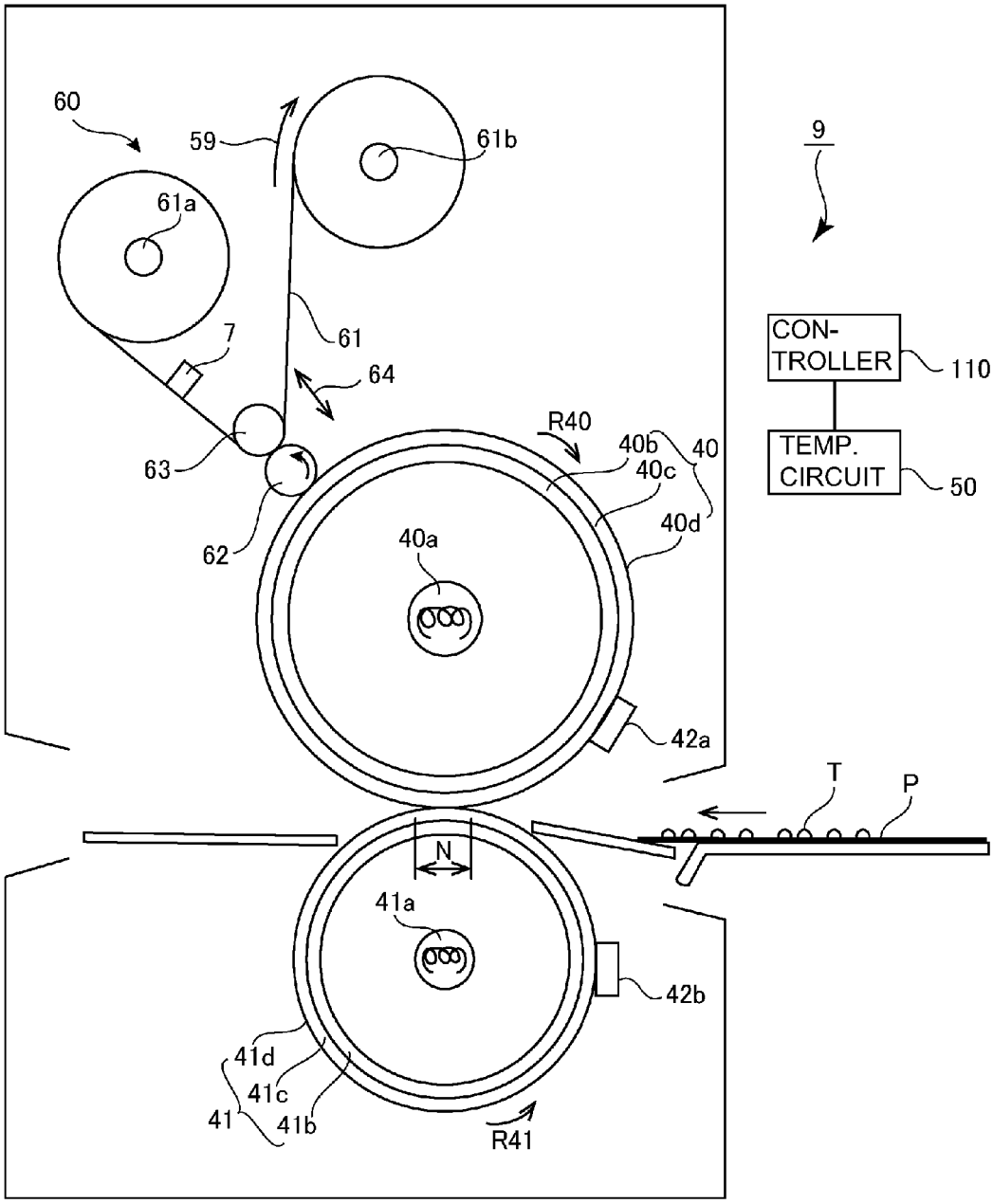
FIG. 2 is an illustration of a structure of a fixing device.

FIG. 2 is an illustration of a structure of the fixing device. As shown in FIG. 2, the fixing device 9 effects fixing by heating and pressing the toner image fixed on the sheet. An unfixed toner image T transferred on the sheet is nipped and fed through a heating nip between a fixing roller 40 and a pressing roller 41 which are rotatable heating members, thus being fixed on the sheet. The fixing roller 40 and the pressing roller 41 are connected with each other by an unshown gear mechanism connecting gears fixed to shaft ends thereof in one side, and are rotationally driven integrally by an unshown driving system, thus being rotated in arrow R40 and R41 directions, respectively. In the fixing device 9, the pressing roller 41 is press-contacted to the fixing roller 40 at a total pressure of about 784 N (about 80 kgf), so that a nip N for the sheet P is formed.

The fixing roller 40 is rotatable by being supported by ball bearings at both end portions. The fixing roller 40 is constituted in a diameter of 60 mm by disposing a 3 mm-thick elastic layer 40*c* on an outer peripheral surface of an aluminum cylindrical core metal 40*b*. A lower layer of the elastic layer 40*c* is a HTV (high-temperature vulcanizing) silicone rubber layer, and on an outer peripheral surface of the HTV silicone rubber layer, an RTV (room-temperature vulcanizing) silicone rubber layer as a heat-resistant elastic layer 40*d* to be contacted to an image surface is disposed. At a rotation center of the fixing roller 40, a halogen heater 40*a* for heating the fixing roller 40 from an inside is disposed non-rotatably.

The pressing roller 41 is rotatable by being supported by ball bearings at both end portions. The pressing roller 41 is constituted in a diameter of 60 mm by disposing a 1 mm-thick elastic layer 41*c* on an outer peripheral surface of an aluminum cylindrical core metal 41*b*. A lower layer of the elastic layer 40*c* is a HTV silicone rubber layer, and on an outer peripheral surface of the HTV silicone rubber layer, a fluorine-containing resin layer as a parting layer 41*d* is disposed. At a rotation center of the pressing roller 41, a halogen heater 41*a* for heating the pressing roller 41 from an inside is disposed non-rotatably.

By combining the fixing roller 40 and the pressing roller 41 each having the above-described layer structure, the parting property against a sharp-melt toner is further enhanced. Further, in order to fix double-side images, at not only the surface of the fixing roller 40 but also the surface of the pressing roller 41, RTV or LTV (low-temperature vulcanizing) silicone rubber having a high toner parting effect is used.

A thermistor 42*a* is provided in contact with the surface of the fixing roller 40. A temperature adjusting circuit 50 adjusts electric power supplied to the halogen heat 40*a* so that a surface temperature of the fixing roller 40 detected by the thermistor 42*a* converges to a target temperature (about 165° C.). A thermistor 42*b* is provided in contact with the surface of the pressing roller 41. The temperature adjusting circuit 50 adjusts electric power supplied to the halogen heater 41*a* so that a surface temperature of the pressing roller 41 detected by the thermistor 42*b* converges to a target temperature (about 140° C.).

An optimum heating quantity for melting the toner image on the sheet P is different depending on a thickness or a weight per unit area (basis weight) of the sheet P, and therefore a controller 110 changes the target temperature for temperature adjustment of the fixing roller 40 depending on a species of the sheet P. However, it takes a time from a change of the target temperature until the surface temperature of the fixing roller 40 converges to the target temperature, and therefore the target temperature is set at a high value correspondingly to the sheet P requiring a large heat quantity, so that the sheets P of many species are heated at the same temperature. In this case, with respect to the sheet P not requiring so large heat quantity, the heat quantity becomes excessively large, so that a hot offset phenomenon such that the melted toner is transferred from the sheet P onto the fixing roller 40 is liable to occur.

For that reason, in the fixing device 9, the fixing roller 40 which is an example of the rotatable heating member is provided with a web cleaning device 60, so that the toner transferred on the fixing roller 40 is removed. A collecting roller 62 which is an example of a rotatable member or a rotatable collecting member is provided in contact with the fixing roller 40 so as to rotate, and the web cleaning device 60 rubs the collecting roller 62 with a cleaning web 61. The collecting roller 62 contacts the cleaning web 61, and therefore solves a problem such that the fixing roller 40 is damaged by the cleaning web 61 or foreign matter confined by the cleaning web 61 to form a stripe on the image.

(Web Cleaning Device)

Figure 3:
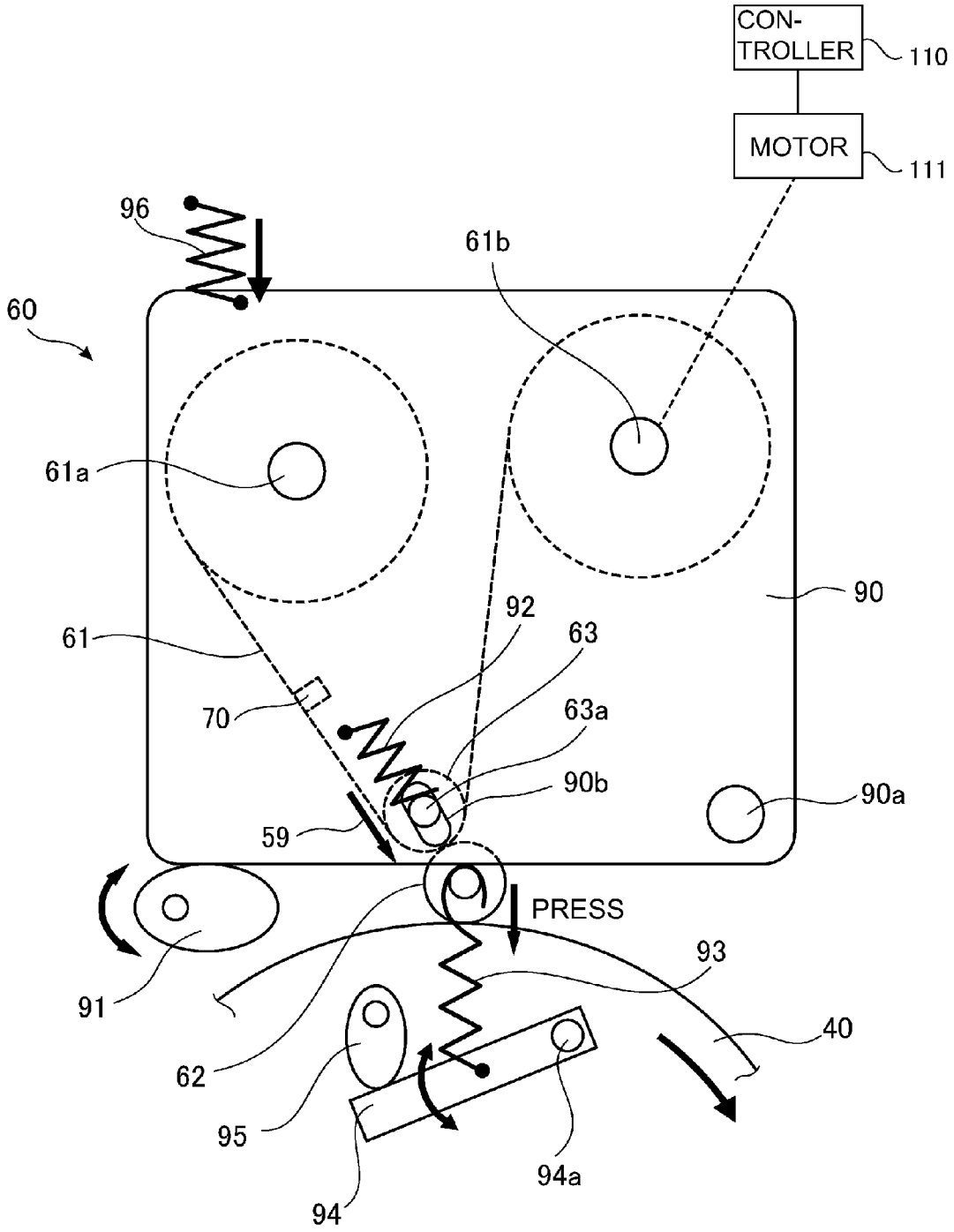
FIG. 3 is an illustration of a structure of a web cleaning device.

FIG. 3 is an illustration of a structure of the web cleaning device 60. As shown in FIG. 3, the web cleaning device 60 includes a sheet-shaped cleaning web (cleaning sheet) 61 formed with a nonwoven fabric and a web roller 63 for urging the cleaning web 61 against the collecting roller 62. The web cleaning device 60 rotates about a unit rotation supporting portion 90*a* and is capable of switching contact and separation (spacing) of the cleaning web 61 relative to the collecting roller 62. The web cleaning device 60 is pressed against a mounting and demounting cam 91 by a unit urging spring 96. A side plate 90 is provided at each of end portions of the respective rollers, and rotatably supports the rollers.

The controller 110 switches the contact and separation of the cleaning web 61 relative to the collecting roller 62 by rotation of the mounting and demounting cam 91. The controller rotationally drives the fixing roller 40 in a contact state of the web roller 63 to remove the toner, collected from the fixing roller 40, by the cleaning web 61. The controller 110 actuates a motor 111 to gradually windup the cleaning web 61, contacting the collecting roller 62, in an arrow 59 direction. As a result, before the cleaning web 61 is partly saturated with the toner, a fresh unused portion of the cleaning web 61 contacts the collecting roller 62 to clean the collecting roller 62.

A fresh (new) cleaning web 61 is mounted on the web feeding shaft 61*a* in a roll state. A terminal portion of the cleaning web 61 is rotatable about the web feeding shaft 61*a*, and a roll of the cleaning web 61 is rotated with pulling-out of the cleaning web 61 from an outside. A starting portion of the cleaning web 61 engages with a web winding-up shaft 61*b*. At one end portion of the web winding-up shaft 61*b*, the motor 111 for winding-up the cleaning web 61 is provided.

The web roller 63 is disposed with a shaft, as the center thereof, formed of a high-rigidity metal (SUS 303) in order to suppress flexure when it contacts the collecting roller 62. In the web roller 63*d*, on the shaft, a silicone sponge which is easily flexed and which has a heat-resistant property and a diameter of 30 mm is wound in order to enhance a broad nip width with the collecting roller 62 to enhance cleaning power. The web roller 63 prevents toner deposition by coating the surface of the silicone sponge with a 100 μm-thick PFA tube.

An end portion 63*a* of the web roller 63 is supported rotatably and slidably in an elongated hole 90*b* provided in the side plate 90. A sliding direction in the elongated hole 90*b* in a direction perpendicular to a tangential line between the web roller 63 and the collecting roller 62. The web roller end portion 63*a* is urged by a web roller urging spring 92 fixed to the side plate 90.

The collecting roller 62 is a cylindrical member formed of SUS 303 in an outer diameter of 20 mm. In the case where the toner is scraped off from the sheet P to effect onto the fixing roller 40, an offset toner is collected by the cleaning web 61 after being collected by the collecting roller 62. The collecting roller 62 is always contacted to the surface of the fixing roller 40 also in a period other than during image formation for the purpose of collecting a deposited matter.

The collecting roller 62 is rotated by the fixing roller 40 with rotation of the fixing roller 40. The collecting roller 62 is rotatable by being supported at both end portions by ball bearings supported movably in a direction of the fixing roller 40. The collecting roller 62 is urged toward the fixing roller 40 by a collecting roller urging spring 93, a collecting roller urging arm 94 and a collecting roller urging cam 95. The collecting roller urging spring 93 is fixed at one end to the end portion of the collecting roller 62 and is fixed at the other end to the collecting roller urging arm 94. When the collecting roller urging cam 95 rotates, the collecting roller urging arm 94 rotates about a rotation shaft 94*a* to change an operating length of the collecting roller urging spring 93, so that a pressure of the collecting roller 62 to the fixing roller 40 is variably set. A variable range of the pressure of the collecting roller 62 to the fixing roller 40 is ON to 80 N.

As described above, the cleaning web 61 which is an example of the web removes the toner, at a cleaning position, deposited on the collecting roller 62 which is an example of a rotatable member. At different positions with respect to a movement direction of the cleaning web 61, cut-away portions 69*a* and 69*b*, arranged in the movement direction, which are examples of a plurality of cut-away portions are formed. The collecting roller 62 which is an example of a mechanism feeds an unused portion of the cleaning web 61 to the cleaning position every predetermined number of times of an image heating process.

(Exchange of Cleaning Web with New One)

In the case where the cleaning web 61 is used up during a continuous heating process, it is desirable that the heating process is immediately prohibited and then the cleaning web 61 is exchanged with a new (fresh) one. However, the exchange of the cleaning web 61 with the new one includes waiting times and the like for cooling and heating the fixing device 9 and therefore produces a large downtime of the image forming apparatus 100. Further, in the case where the cleaning web 61 is used up in a final stage in which the heating process in a large amount is carried out, when the heating process is interrupted immediately at that time, the interruption is not in keeping with a user demand such that the user wishes to end a remaining heating process.

For that reason, in the fixing device 9 calls a user's attention, at the time when the cleaning web 61 remains in some amount, by displaying a recommendation such that "A remaining amount of cleaning web 61 is small and is needed to be exchanged soon" on an operating panel 112 (FIG. 4) which is a notifying portion. Thereafter the heating process is further continued, so that the user demand such that the user wishes to end the heating process is fulfilled.

However, immediately before the remaining amount of the cleaning web 61 is reduced to zero, a warning such that "A remaining amount of cleaning web 61 is reduced to zero and therefore please immediately exchange cleaning web 61" is displayed on the operating panel 112 (FIG. 4), and a further heating process is prohibited. This is because when the heating process is continued in a state in which the remaining amount of the cleaning web 61 is reduced to zero, the collecting roller 62 cannot be cleaned by the cleaning web 61, and a toner contamination carried by the fixing roller 40 is increased in amount and is deposited on the sheet P, so that a quality of an output image is lowered.

(Detection of Remaining Amount of Cleaning Web)

Figure 4:
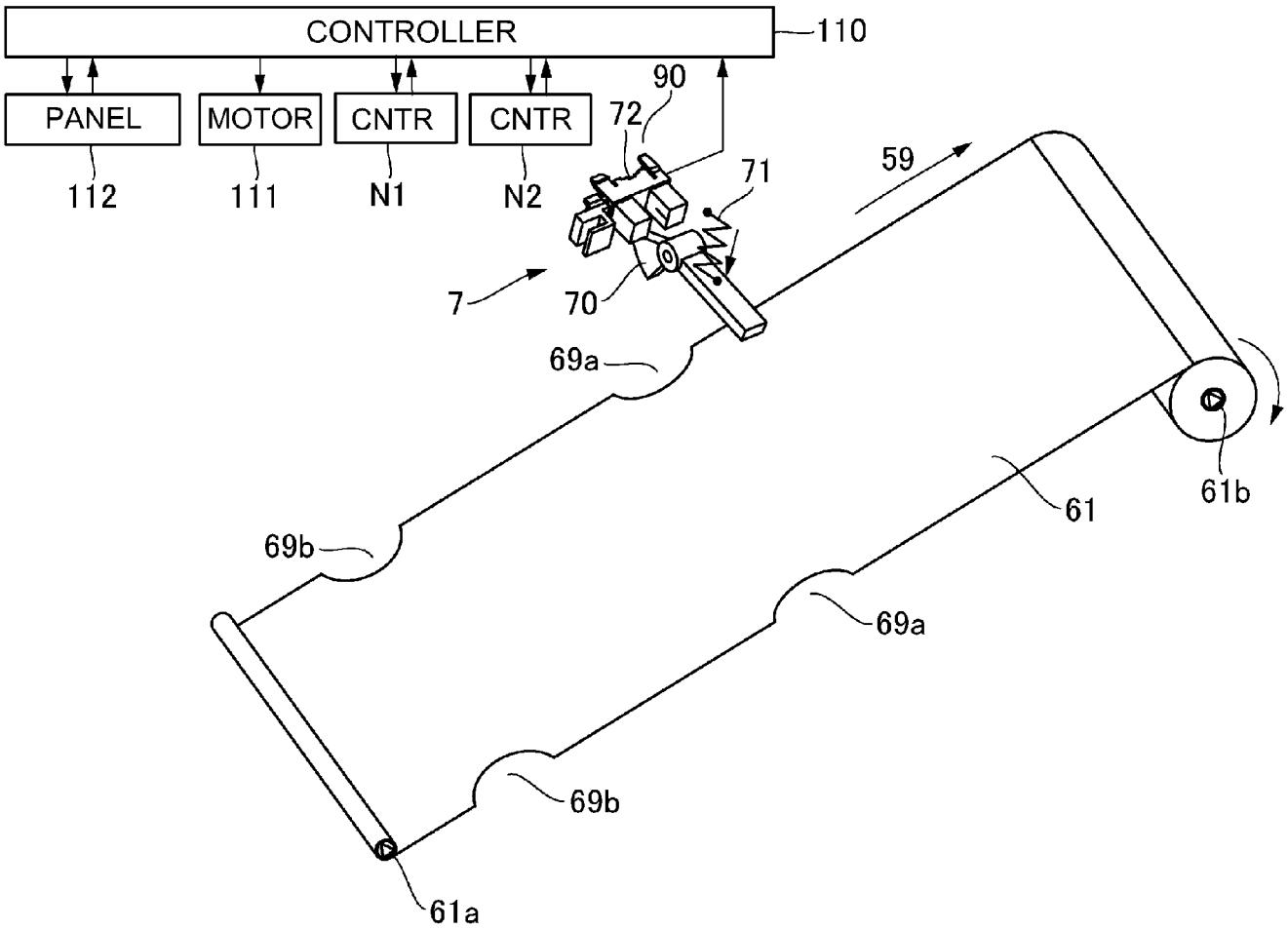
FIG. 4 is an illustration of a remaining amount detecting method of a cleaning web.
Figure 5:
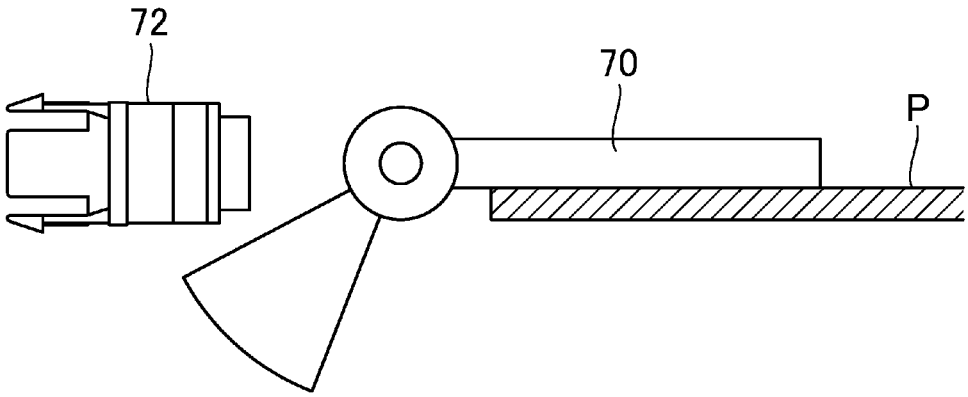
FIG. 5 is an illustration of an operation of a cut-away portion sensor.
Figure 5:
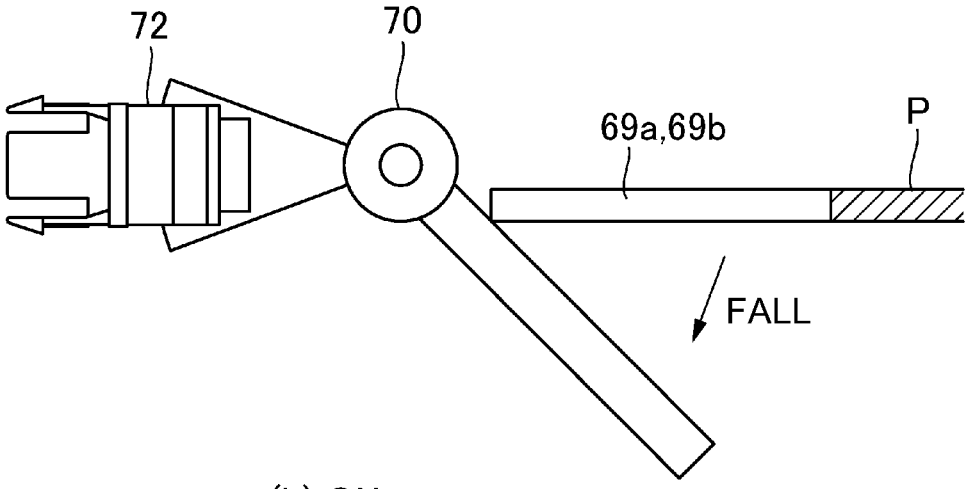
Figure 6:
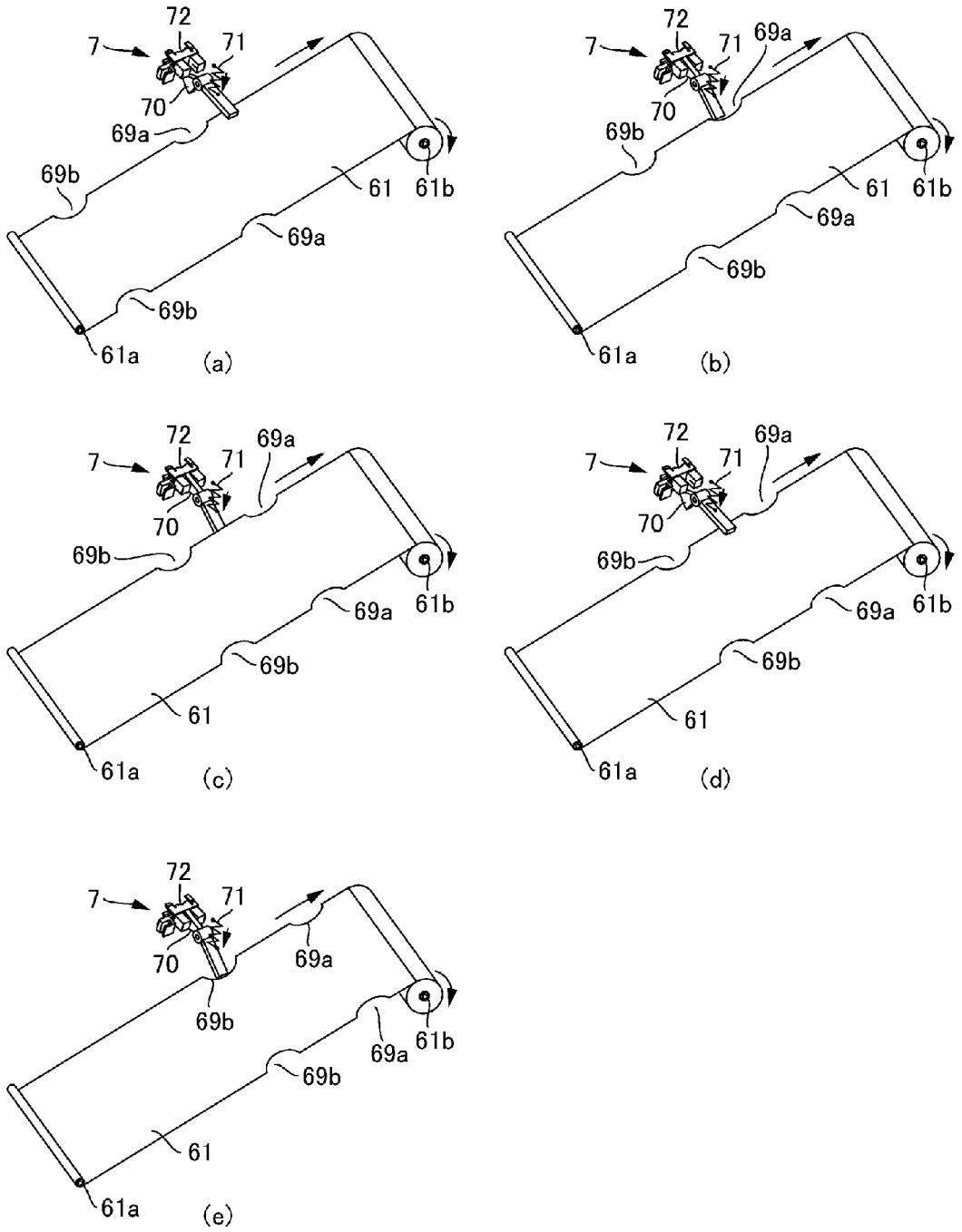
FIG. 6 is an illustration of a structure of a terminal detecting sequence of the cleaning web.

FIG. 4 is an illustration of a remaining amount detecting method of the cleaning web. FIG. 5 is an illustration of an operation of a cut-away portion sensor. FIG. 6 is an illustration of a terminal detecting sequence of the cleaning web.

As shown in FIG. 4, the cleaning web 61 is provided with first cut-away portions (displacing portions) 69*a* in an upstream portion of the movement direction and is provided with second cut-away portions (displacing portions) 69*b* upstream of the first cut-away portions 69*a*. The cut-away portions 69*a* and 69*b* are arranged along an associated edge of the cleaning web 61 in the same side. A cut-away portion sensor 7 is provided in a movement path of the cleaning web 61 and is capable of detecting the cut-away portion 69*b* after detecting the cut-away portion 69*a*.

The motor 111 which is example of the mechanism moves the cleaning web 61 in the movement direction at a predetermined rate with accumulation of the sheet heating process. The controller 110 actuates the motor 111 at a predetermined rate with accumulation of image formation, so that the cleaning web 61 is gradually wound up in the arrow 59 direction. A web feeding amount per sheet of an A4-sized sheet P fed in a long edge feeding manner is 0.5 mm/sheet. The motor 111 may also be actuated every image formation of 10 sheets to feed the cleaning web 61 by 5 mm.

Each of the cut-away portions 69*a* and 69*b* is formed at two positions of the cleaning web 61. In order to detect the cut-away portions 69*a* and 69*b* with movement of the cleaning web 61, the cut-away portion sensor 7 is provided on the side plate 90. A flag 70 of the cut-away portion sensor 7 is contacted to the cleaning web 61. The flag 70 which is an example of a contact portion is urged by a web flag spring 71 which is an urging portion to contact the cleaning web 61 at a contact pressure of 50 g.

As shown in FIG. 5, the cut-away portion sensor 7 detects a rotational (movement) position of the flag 70 by a photo-sensor 72. The photo-sensor 72 which is an example of a detecting portion detects that the flag 70 which is an example of a contact portion was displaced at the associated cut-away portion 69*a* or 69*b*.

At a position of the cut-away portion 69*a* or 69*b*, the flag 70 supported by the cleaning web 70 falls (rotates downwardly), so that the cut-away portion 69*a* or 69*b* is detected by the photo-sensor 72 linked with the flag 70. When the flag 70 falls through the cut-away portion 69*a* or 69*b*, the state of the photo-sensor 72 is transferred from a light-transmission state (OFF) to a light-blocked state (ON). When the state of the photo-sensor 72 is changed from the OFF state to the ON state, the controller 110 recognizes that the flag 70 reaches the cut-away portion 69*a* or 69*b*, and then evaluates a remaining amount of the cleaning web 61.

As shown in FIG. 4, a distance from a starting end of the cleaning web 61 to the first cut-away portion 69*a* is 5000 mm. A feeding amount per sheet of the sheet P is 0.5 mm/sheet, and therefore when about 10,000 sheets are heated after the cleaning web 61 is exchanged with the new cleaning web, the first cut-away portion 69*a* is detected. The first cut-away portion 69*a* is formed at a position corresponding to a position of the sheet preceding the final sheet, for which the remaining amount of the cleaning web 61 completely becomes zero, by 170 sheets. The first cut-away portion 69*a* is formed at a position corresponding to a position corresponding to a position of the sheet preceding the final sheet, for which the remaining amount of the cleaning web 61 completely becomes zero, by 20 sheets. A distance from the first cut-away portion 69*a* to the second cut-away portion 69*b* of the cleaning web 61 is 75 mm. The feeding amount per sheet of the sheet P is 0.5 mm/sheet, and therefore about 150 sheets can be heated even when the first cut-away portion 69*a* is detected.

Timing when the second cut-away portion 69*b* of the cleaning web 61 is detected by the cut-away portion sensor 7 is immediately before a terminal (end point) of the cleaning web 61. For this reason, in control of Comparison Example, the controller 110 prohibits, when the second cut-away portion 69*b* is detected by the cut-away portion sensor 7, the heating of the sheet P from then on.

As shown in (a) of FIG. 6, the flag 70 is supported by the cleaning web 61 from the starting end of the cleaning web 61 to the first cut-away portion 69*a*, and keeps the photo-sensor 72 in the light-transmission state. As shown in (b) of FIG. 6, when the first cut-away portion 69*a* of the cleaning web 61 reaches the flag 70, the flag 70 falls through the cut-away portion 69*a*, so that the state of the photo-sensor 72 is transferred from the light-transmission state (OFF) to the light-blocked state (ON). When the state of the photo-sensor 72 is changed from the OFF state to the ON state, the controller 110 causes the operating panel 112 (FIG. 4) to display an exchange (replacement) demand of the cleaning web 61 to permit an end of a continuing heating within the limit of 100 sheets.

For this reason, as shown in (c) of FIG. 6, even in a state in which the flag 70 falls through the first cut-away portion 69*a*, the heating of the sheet P within the limit of 100 sheets is carried out. Then, when the heating of 100 sheets of the sheet P is carried out in the ON state of the photo-sensor 72, the controller 110 prohibits the heating.

(Control in Comparison Example)

As shown in (d) of FIG. 6, in a period until the heating of 100 sheets of the sheet P is carried out in the ON state of the photo-sensor 72, there is a possibility that an erroneous operation or the like is made to return the flag 70 onto the cleaning web 61. Further, an input signal of the photo-sensor 72 into the controller 110 is the same between the case where the flag 70 is returned onto the cleaning web 61 and the case where the cleaning web 61 is exchanged with the new cleaning web.

For this reason, in the control in Comparison Example, the controller 110 discriminates that the cleaning web 61 is exchanged with the new cleaning web, and cancels the message of "Exchange requirement of cleaning web 61" on the operating panel 112 (FIG. 4). At the same time, the controller 110 also eliminates a limitation of "100 sheets after detection of first cut-away portion 69*a*". As a result, the controller 110 cannot prohibit the heating of the sheet P even when an accumulated number of sheets subjected to the heating of the sheet P reaches 100 sheets after the photo-sensor 72 detected the first cut-away portion 69*a*. When the heating is continued while exceeding the limitation of "100 sheets after detection of first cut-away portion 69*a*", the cleaning web 61 reaches its terminal and is locked, so that the cleaning web 61 rubs the collecting roller 62 in a state in which the toner is deposited on the cleaning web 61 in a large amount. At this time, there is a possibility that the toner is transferred from the cleaning web 61 onto the collecting roller 62 and is fixed on the image on the sheet P to generate in which contamination.

On the other hand, as shown in (e) of FIG. 6, in Embodiment 1, the flag 70 falls through the second cut-away portion 69*b* before the cleaning web 61 is placed in such a state, so that the state of the photo-sensor 72 is transferred from the light-transmitted state (OFF) to the light-blocked state (ON). Then, the controller 110 recognizes that the cleaning web 61 is not actually exchanged with the new cleaning web, and prohibits the image formation and at the same time causes the operating panel 112 (FIG. 4) to display a message of "Error due to abnormal operation". In place of the message of "Error due to abnormal operation", the operating panel may also display the message of "Exchange requirement of cleaning web 61".

(Control in Embodiment 1)

Figure 7:
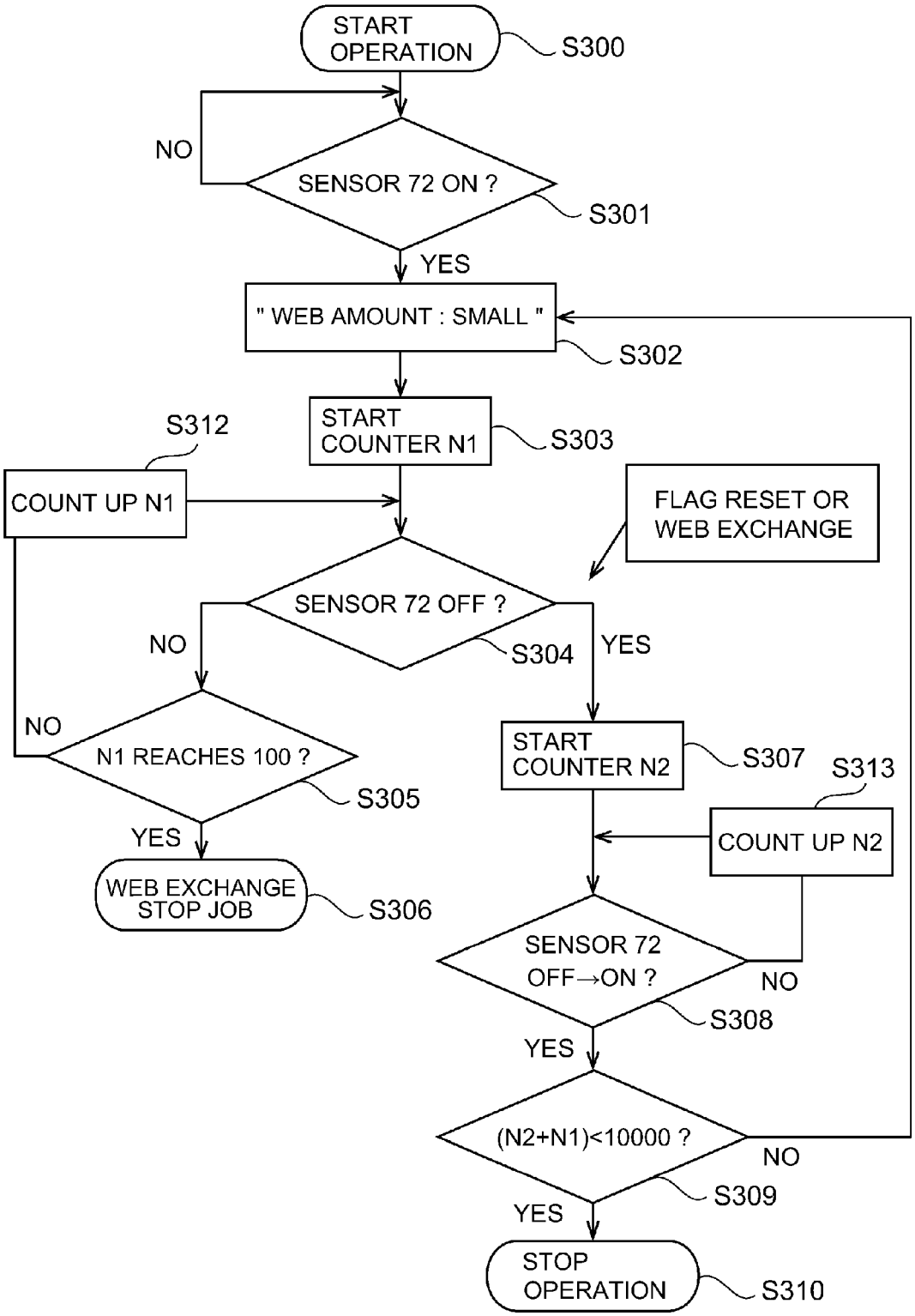
FIG. 7 is a flowchart of terminal detecting control of the cleaning web.

FIG. 7 is a flowchart of cleaning web terminal detection control. In Embodiment 1, in order to discriminate whether the cleaning web 61 is exchanged with the new cleaning web or the user returns the flag 70 onto the cleaning web 61 when the flag 70 is returned onto the cleaning web 61, heating (heat treatment) accumulation amount is measured using a counter N2. In the case where the flag 70 falls to a position below the cleaning web 61 again before the counter N2 counts 10000 sheets corresponding to a normal lifetime of the cleaning web 61, the controller 110 discriminates that "User returns flag (onto cleaning web)" and immediately stops the heating of the sheet P. As a result, it is possible to stop movement of the cleaning web 61 with reliability before the cleaning web 61 reaches its terminal.

As shown in FIG. 7 with reference to FIG. 4, when the state of the photo-sensor 72 is changed from the light-transmission state to the light-blocked state during continuous image formation (YES of S301), the controller 110 gives a message of "Warning of small remaining amount of cleaning web" (S302), and then starts a counter N1 (S303). The counter N1 which is an example of a first counting portion counts the number of times of the image heating carried out after the flag 70 is displaced.

The message of "Warning of small remaining amount of cleaning web" is a warning message such that "Amount of cleaning web 61 becomes zero soon". Further, with respect to the counter N1, a threshold was set at 100 so that the heating of 100 sheets (A4 size) is enabled in the state of "Warning of small remaining amount of cleaning web". The operating panel 112 which is an example of a notifying portion provides a notification of an exchange of the cleaning web 61 depending on the displacement of the flag 70.

Thereafter, when the light-blocked state of the photo-sensor 72 is continued all this while (NO of S304) and the counter N1 reaches 100 (YES of S305), the controller 110 causes the operating panel 112 to display a message of "Cleaning web exchange instruction" and temporarily stops the continuous image formation (S306). The controller 110 which is an example of a prohibiting portion prohibits the image heating with timing when the number of times counted by the counter N1 reaches 100 sheets which is an example of a first predetermined number of times.

In the case where the state of the photo-sensor 72 is changed from the light-blocked state to the light-transmission state in a period from the sending of the message of "Warning of small remaining amount of cleaning web" until before the counter N1 reaches 100 (YES of S304), the controller 110 starts the counter N2 (S307). When the flag 70 is returned onto the cleaning web 61, the counter N2 counts a subsequent accumulated number of sheets subjected to the heating in order to discriminate whether the operation is "Exchange of cleaning web with new cleaning web" or "Elimination of limitation of erroneous operation (performed) by user". The counter N2 which is an example of a second counting portion counts the number of times of the image heating carried out after the flag 70 is returned onto the cleaning web 61 and is contacted to the cleaning web 61.

Thereafter, when the state of the photo-sensor 72 is switched from the light-transmission state to the light-blocked state (YES of S308), if the counter 112 indicates within 10000 sheets (YES of S309), the controller 110 discriminates that the operation is "Elimination of limitation of erroneous operation (performed) by user" and prohibits the heating (S310). The controller 110 prohibits the image heating in the case where the displacement of the flag 70 through the cut-away portion 69*a* or 69*b* is detected in a state in which the number of times counted by the counter N2 is less than a second predetermined number of times or less than 10000 sheets which is an example of the predetermined accumulation amount.

When the state of the photo-sensor 72 is switched from the light-transmission state to the light-blocked state (YES of S308), in the case where the counter N2 indicates 10000 sheets or more (NO of S309), the controller 110 discriminates that the operation is "Exchange of cleaning web with new cleaning web was made". Then, the controller 110 starts the counter N1 (S303) and is on standby for detection of the first cut-away portion 69*a* (YES of S304). In the case where the flag 70 is displaced through the cut-away portion 69*a* or 69*b* in a state in which the number of times counted by the counter N2 is not less than the second predetermined number of times or not less than 10000 sheets which are an example of not less than the predetermined accumulation amount, the controller 110 notifies the operating panel 112 of exchange of the cleaning web 61.

(Effect of Embodiment 1)

In Embodiment 1, when the cut-away portion sensor 7 detects the cut-away portion 69*a*, the controller 110 which is the example of the prohibiting portion prohibits the image heating in a stage in which the accumulation amount of the heating after the detection reaches 100 sheets which are an example of a first accumulation amount. 100 sheets corresponds to an accumulated feeding amount in a distance shorter than the distance between the cut-away portions 69*a* and 69*b*. Further, when the cut-away portion sensor 7 detects the cut-away portion 69*b*, the controller 110 prohibits the image heating in a stage in which the accumulation amount of the heating after the detection reaches 0 sheets which are an example of a second accumulation amount smaller than the first accumulation amount.

In Embodiment 1, the second accumulation amount is 0, and therefore the heating is prohibited immediately. Further, the first accumulation amount is smaller than the accumulation amount of the heating of the cleaning web 61 moved in the distance from the cut-away portion 69*a* to the cut-away portion 69*b*, and therefore there is no need to worry about the pulling-out of the cleaning web 61 such that the cut-away portion 69*b* exceeds the flag 70.

In Embodiment 1, when the cut-away portion sensor 7 detects the cut-away portion 69*a* and when the cut-away portion sensor 7 detects the cut-away portion 69*b*, the controller 110 which is an example of an exchange requiring (demounting) portion causes the operating panel 112 to output a display requiring the exchange of the cleaning web 61. For this reason, an operator is capable of preparing for an exchange operation of the cleaning web 61 while continuing the image formation.

In Embodiment 1, the first cut-away portion 69*a* is used for displaying, on the operating panel 112, a warning such that "Remaining amount becomes small and cleaning web 61 becomes zero soon". The second cut-away portion 69*b* is not used in a normal state. However, in the case where the user makes the erroneous operation after the flag 70 falls through the first cut-away portion 69*a* to move the flag 70 onto the cleaning web 61, a warning of "Immediate exchange of cleaning web" is displayed on the operating panel 112 by using the second cut-away portion 69*b*. Accordingly, even in the case where an unintended user's action different from a normal method of use is taken, it is possible to ensure a cleaning performance of the fixing roller 40 by preventing the pulling-out of the cleaning web 61 to the terminal. Even when the user takes the unintended action, breakage of parts is not readily caused, so that a lowering in running cost and an improvement in usability are realized. Further, downtime is reduced to the possible extent, so that it is possible to enhance productivity. The fixing roller 40 is cleaned by the cleaning web 61, so that it is possible to provide the image forming apparatus with high image quality and high productivity.

Embodiment 2

A fixing device in Embodiment 2 is constituted as shown in FIG. 2 similarly as in Embodiment 1 and is mounted in the image forming apparatus shown in FIG. 1. The web cleaning device shown in FIG. 3 is mounted, and as shown in FIG. 1, the cut-away portion sensor 7 detects the cut-away portions 69*a* and 69*b* on the cleaning web 61, and the controller 110 controls the continuation and the prohibition of the image formation.

However, in Embodiment 2, the controller 110 measures an accumulation amount of movement of the cleaning web 61 from the detection of the cut-away portion 69*a* or 69*b* on the cleaning web 61 by the cut-away portion sensor 7 until the cut-away portion 69*a* or 69*b* is subsequently detected. Then, depending on the measured accumulation amount of movement, the controller 110 control, the continuation and the prohibition of the image formation.

As shown in FIG. 3, the web roller 63 is provided with a rotary encoder for reversing an output signal by turning on or off every degree of a rotation angle of the web roller 63. The controller 110 counts an output pulse of the rotary encoder to obtain a rotation amount (nearly equal to an accumulated value of a feeding length of the cleaning web 61) of the web roller 63 from the detection of the cut-away portion (69*a* or 69*b*) to the detection of the subsequent cut-away portion (69*b* or 69*a*). Then, in the case where the accumulation amount of the feeding length of the cleaning web 61 exceeds 150 mm, the controller 110 discriminates that a new cut-away portion 69*a* is detected, and allows the continuation of image formation of 100 sheets. However, in the case where the accumulation amount of the feeding length is 150 mm or less, the controller 110 discriminates that the cut-away portion 69*b* is detected, and immediately prohibits the image formation.

Embodiment 3

In a fixing device in Embodiment 3, the collecting roller 62 is demounted from the fixing device 9 in Embodiment 1 shown in FIG. 2, and the web cleaning device 60 shown in FIG. 3 removes the toner, deposited on the fixing roller 40 by directly rubbing the fixing roller 40 with the cleaning web 61.

In this way, even in the case where the fixing roller 40 is directly rubbed with the cleaning web 61, as shown in FIG. 4, it is possible to carry out control similar to the control in Embodiment 1 by using the cleaning web 61 provided with the cut-away portions 69*a* and 69*b*, the cut-away portion sensor 7 and the controller 110. If the number of sheets subjected to image formation from the detection of the cut-away portion (69*a* or 69*b*) until the subsequent cut-away portion (69*b* or 69*a*) exceeds 10000 sheets, additional image formation of 100 sheets is allowed without prohibiting the image formation. However, in the case where the sheet number is less than 10000 sheets, the controller 110 discriminates that the cut-away portion 69*b* is detected, and immediately prohibits the image formation.

Incidentally, in Embodiments 1, 2 and 3, the embodiment in the web cleaning device 60 incorporated in the fixing device 9 was described. However, similar control can be carried out, as shown in FIG. 1, also in the belt cleaning device 22 for removing the transfer residual toner on the intermediary transfer belt 130 for the purpose of detecting the end of the cleaning web with reliability.

Modified Embodiments

The present invention can be carried out also in other embodiments in which a part or all of constitutions in Embodiment 1 to 3 are replaced with alternative constitutions thereof. With respect to dimensions, materials, shapes and relative arrangements of constituent elements described in Embodiments 1 to 3, the present invention is not intended to be limited to only those described in Embodiments 1 to 3 unless otherwise specified particularly.

For example, the web including the cut-away portion shown in FIG. 4 is not limited to the web prepared by forming a rectangular sheet and then by partly cutting an edge in a semicircular shape. A web may be prepared by forming a semicircular recessed portion without cutting an edge of the rectangular sheet simultaneously with molding of the rectangular sheet. That is, "cut-away" of the cut-away portion means a "recessed portion recessed in a width direction" and does not necessarily mean "cut".

A winding-up interval shown in FIG. 4 may also be "every execution of image heating in predetermined number of times", i.e., one-sheet interval or two-sheet interval of image output. Further, web winding-up timing may also strictly be not an interval between adjacent two images (i.e., a sheet (paper) interval).

In the flowchart of FIG. 7, a method of "notifying exchange of web" is not limited to an example in which "character display" is made at a liquid crystal display portion provided in the operating portion of the printer (copying machine). The method can be variously modified so long as the function of the "notifying portion" such that a signal for urging the operator to exchange the web is outputted to a notifying device (display portion, a speaker or the like) is fulfilled. An example in which the "display" is made on an image display portion of an input terminal network-connected with the printer (having no display portion), a monitor connected with a personal computer, or the like may also be employed. Further, the method is not limited to the (screen) image but may also be an example in which "exchange of web" is notified by "sound (voice)" from the speaker or an example in which a red lamp indicating the "exchange of web" is blinked.

Further, with respect to the message to be displayed at the "notifying portion", other than the example such that "Web becomes zero", an example such that "Please exchange web" may also be employed. If the message suggests that the operator is urged to exchange the web, the message may also be such that "Apparatus stops in remaining amount of 000 sheets".

Further, the example of movement of the flag is not limited to the example in which "Flag contacts upper surface of web (by being urged) to fall (separate) downward from web at position of cut-away portion 69*a* or 69*b*" shown in FIG. 4. Contrary to the example shown in FIG. 4, an example in which "Flag contacts lower surface of web by upwardly urged to pass through and be spaced upwardly from web at position of cut-away portion 69*a* or 69*b*" may also be employed.

Further, in the flowchart of FIG. 7, a job stop or an error stop means that "Image forming process (image heating) is prohibited". "Image forming process (image heating) is prohibited" means that if the job is in operation, the job is interrupted at that point of time and that if the operation is on standby, the job is not carried out even when the job is received.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 021383/2014 filed Feb. 6, 2014, which is hereby incorporated by reference.

What is claimed is:

1. An electrophotographic image forming apparatus comprising:

a rotatable member;

a web configured to remove a toner, deposited on the rotatable member, in a cleaning position;

a mechanism configured to feed an unused portion of the web to the cleaning position every predetermined number of times of an image forming process;

a contact portion configured to contact a surface of the web;

a plurality of displacing portions formed in different positions with respect to a movement direction of the web and configured to permit displacement of the contact portion;

a detecting portion configured to detect the displacement of the contact portion at each of the displacing portions;

a notifying portion configured to notify an exchange of the web depending on an output of the detecting portion;

a first counting portion configured to count the number of times of the image forming process executed after the contact portion is displaced at each of the displacing portions;

a prohibiting portion configured to prohibit the image forming process when the number of times of the image forming process counted by the first counting portion reaches a number of prohibition; and a second counting portion configured to count the number of times of the image forming process executed after the contact portion returns to a contact state with the surface of the web, wherein the prohibiting portion prohibits the image forming process when the detecting portion detects the displacement of the contact portion when the number of times of the image forming process counted by the second counting portion is less than the predetermined number, and wherein the notifying portion prompts the exchange of the web when the detecting portion detects the displacement of the contact portion when the number of times is not less than the predetermined number.

2. An electrophotographic image forming apparatus according to claim 1, wherein the mechanism includes a first roller about which the web is wound, a second roller configured to wind up the web, and a third roller configured to urge the web toward the rotatable member in the cleaning position, wherein the second roller is driven for a predetermined time every execution of the predetermined number of times of the image forming process.

3. An electrophotographic image forming apparatus according to claim 2, wherein the web and the mechanism are detachably mounted to a main assembly of the electrophotographic image forming apparatus as a unit.

4. An electrophotographic image forming apparatus according to claim 1, further comprising an urging portion configured to urge the contact portion toward the surface of the web.

5. An electrophotographic image forming apparatus according to claim 1, wherein each of the first displacing portion and the second displacing portion is a recessed portion formed at an end portion of the web.

6. An electrophotographic image forming apparatus according to claim 1, wherein the notifying portion includes a display portion configured to display a message to urge the exchange of the web.

7. An electrophotographic image forming apparatus comprising:

an image forming portion configured to form a toner image on a sheet;

a fixing portion configured to fix the toner image formed on the sheet by the image forming portion;

a rotatable member provided in the fixing portion;

a web configured to remove a toner, deposited on the rotatable member, in a cleaning position;

a mechanism configured to feed an unused portion of the web to the cleaning position every predetermined number of times of an image forming process;

a contact portion configured to contact a surface of the web;

a plurality of displacing portions formed in different positions with respect to a movement direction of the web and configured to permit displacement of the contact portion;

a detecting portion configured to detect the displacement of the contact portion at each of the displacing portions;

a notifying portion configured to notify an exchange of the web depending on an output of the detecting portion;

a first counting portion configured to count the number of times of the image forming process executed after the contact portion is displaced at each of the displacing portions;

a prohibiting portion configured to prohibit the image forming process when the number of times of the image forming process counted by the first counting portion reaches a number of prohibition; and a second counting portion configured to count the number of times of the image forming process executed after the contact portion returns to a contact state with the surface of the web, wherein the prohibiting portion prohibits the image forming process when the detecting portion detects the displacement of the contact portion when the number of times of the image forming process counted by the second counting portion is less than the predetermined number, and wherein the notifying portion prompts the exchange of the web when the detecting portion detects the displacement of the contact portion when the number of times is not less than the predetermined number.

8. An electrophotographic image forming apparatus according to claim 7, wherein the mechanism includes a first roller about which the web is wound, a second roller configured to wind up the web, and a third roller configured to urge the web toward the rotatable member in the cleaning position, wherein the second roller is driven for a predetermined time every execution of the predetermined number of times of the image forming process.

9. An electrophotographic image forming apparatus according to claim 8, wherein the web and the mechanism are detachably mounted to a main assembly of the electrophotographic image forming apparatus as a unit.

10. An electrophotographic image forming apparatus according to claim 7, further comprising an urging portion configured to urge the contact portion toward the surface of the web.

11. An electrophotographic image forming apparatus according to claim 7, wherein each of the first displacing portion and the second displacing portion is a recessed portion formed at an end portion of the web.

12. An electrophotographic image forming apparatus according to claim 7, wherein the notifying portion includes a display portion configured to display a message to urge the exchange of the web.

13. An electrophotographic image forming apparatus according to claim 7, wherein the fixing portion includes a rotatable heating member configured to heat the toner image on the sheet, and wherein the rotatable member collects a toner deposited on the rotatable heating member while being rotated by rotation of the rotatable heating member.

* * * * *